US008100607B2

(12) United States Patent
Custers

(10) Patent No.: US 8,100,607 B2
(45) Date of Patent: Jan. 24, 2012

(54) ROCK ANCHOR

(76) Inventor: Robert Custers, Randpark Ext. 4 (ZA)

( * ) Notice: Subject to any disclaimer, the term of this patent is extended or adjusted under 35 U.S.C. 154(b) by 16 days.

(21) Appl. No.: 12/743,617

(22) PCT Filed: Nov. 19, 2008

(86) PCT No.: PCT/IB2008/054851

§ 371 (c)(1),
(2), (4) Date: May 19, 2010

(87) PCT Pub. No.: WO2009/066246

PCT Pub. Date: May 28, 2009

(65) Prior Publication Data

US 2010/0260557 A1 Oct. 14, 2010

(30) Foreign Application Priority Data

Nov. 21, 2007 (ZA) ..... 2007/10057

(51) Int. Cl.
*E21D 21/00* (2006.01)
*E21D 20/00* (2006.01)
*F16B 13/04* (2006.01)

(52) U.S. Cl. ..... 405/259.3; 405/259.1; 411/19

(58) Field of Classification Search ..... 405/259.1, 405/259.3, 259.4, 259.5; 411/14, 15, 19
See application file for complete search history.

(56) References Cited

U.S. PATENT DOCUMENTS 4,459,067 A * 7/1984 Skogberg et al. ..... 405/259.3
4,511,289 A * 4/1985 Herron ..... 405/259.3
4,696,606 A * 9/1987 Herron ..... 405/259.3
4,954,017 A * 9/1990 Davis et al. ..... 405/259.3
5,765,969 A * 6/1998 Kareby et al. ..... 405/259.3
5,997,219 A * 12/1999 Krzysztalowicz et al. 405/259.3
2004/0035212 A1 2/2004 McKelvey
2007/0217869 A1 9/2007 Dawe

FOREIGN PATENT DOCUMENTS

WO WO2005/003609 A 1/2005

OTHER PUBLICATIONS

PCT International Search Report and Written Opinion for PCT/IB2008/054851.

* cited by examiner

*Primary Examiner* — David Bagnell
*Assistant Examiner* — Kyle Armstrong
(74) *Attorney, Agent, or Firm* — Myers Bigel Sibley & Sajovec, PA

(57) ABSTRACT

The invention relates to a rock anchor including an elongate, hydraulically inflatable anchor tube made of a ductile material and defining a closed leading end, a trailing end, and a tube cavity extending between the ends. The rock anchor of the invention includes an end cap on a trailing end of the tube, defining a feed aperture in communication with the tube cavity for pressure feeding a liquid substance into the tube cavity for inflating the tube. The end cap includes pressure indicator means configured for indicating when, as a result of pressure feeding of a liquid substance into the tube cavity, a predetermined installation pressure is reached in the tube cavity. The pressure indicator means typically includes a pressure indicator formation displaceable under pressure in the tube cavity, with such displacement being visible from the outside of the end cap.

9 Claims, 5 Drawing Sheets

ROCK ANCHOR

RELATED APPLICATIONS

This application is a 35 U.S.C. §371 national stage application of PCT Application No. PCT/IB2008/054851, filed on Nov. 19, 2008, which claims priority from South African Application No. 2007/10057 filed Nov. 21, 2007, the contents of which are incorporated herein by reference in their entireties.

THIS INVENTION relates to a rock anchor.

A known type of rock anchor used for support in mining and construction, includes an elongate, hydraulically inflatable anchor tube made of a ductile material and defining a closed leading end, a trailing end, and a tube cavity extending between the ends. The rock anchor includes a feed aperture via which a suitable liquid substance, e.g. water, can be pressure fed into the tube cavity. For installation of the rock anchor, the anchor tube is inserted into a bore in rock. Upon a liquid substance being pressure fed into the anchor tube under a predetermined installation pressure, the tube is hydraulically inflated and, constrained in the bore, provides a frictional bond with the rock. The invention particularly relates to a rock anchor of this type and any reference hereinafter to a rock anchor is a reference to such a rock anchor.

According to the invention there is provided a rock anchor which includes:

- an elongate, hydraulically inflatable anchor tube made of a ductile material and defining a closed leading end, a trailing end, and a tube cavity extending between the ends;
- an end cap on a trailing end of the tube, defining a feed aperture in communication with the tube cavity for pressure feeding a liquid substance into the tube cavity for inflating the tube; and
- pressure indicator means, carried by the end cap, configured for indicating when, as a result of pressure feeding of a liquid substance into the tube cavity, a predetermined installation pressure is reached in the tube cavity.

In a particular embodiment of the rock anchor of the invention, the pressure indicator means may include:

- a body defining a contact surface exposed to an end cap cavity defined in the end cap, the end cap cavity being in communication with the tube cavity, the body before installation of the rock anchor being in a first position thereof relative to the end cap, and the body being displaceable, under liquid pressure against the contact surface, into a second position thereof;
- an indicator formation, before installation of the rock anchor being in a first position thereof relative to the end cap and being displaceable into a second position thereof through displacement of the body into its second position, the second and first positions of the indicator formation being visually distinguishable from the outside of the end cap; and
- holding means holding the body in its first position against pressure on the contact surface, the holding means being configured for yielding when the predetermined installation pressure is reached in the end cap cavity.

In the said embodiment, the indicator formation and the body of the pressure indicator means may define a single part.

In the said embodiment, the holding means may include a frangible formation.

In the said embodiment, the holding means may include biasing means biasing the body of the pressure indicator means towards its first position.

In the said embodiment, the end cap may include:

- a ferrule having opposite first and second ends, secured to the trailing end of the anchor tube so that the anchor tube extends from the first end; and
- an end wall at the second end.

In the case of the rock anchor including the said ferrule, the feed aperture may be defined through the ferrule.

In the case of the rock anchor including the said ferrule:

- the end wall may define therethrough an indicator formation aperture for the indicator formation;
- the direction from the first position to the second position of the indicator formation may be the same as the direction from the first end to the second end of the ferrule; and
- when in its second position, the indicator formation may protrude from the end wall through the indicator formation aperture.

In the case of the end wall defining therethrough the indicator formation aperture, the aperture may be central in the end wall.

In the case of the end wall defining therethrough the indicator formation aperture, the end wall and the body of the pressure indicator means may define complementary seat formations that sealingly abut each other in the second position of the body, thus closing off the indicator formation aperture. Alternatively, the pressure indicator means may be configured for permitting release of pressure from the tube cavity via the indicator formation aperture when the indicator formation is in its second position.

The rock anchor may include a non-return closure for the feed aperture.

A particular embodiment of the rock anchor including the ferrule may include also a non-return closure for the feed aperture, the closure including a resiliently flexible annular formation which is fitted snugly inside the ferrule, which normally closes off the feed aperture, and which is locally displaceable away from the ferrule under pressure of a liquid substance into the feed aperture.

The invention is described below by way of example with reference to and as illustrated in the accompanying diagrammatic drawings. In the drawings.

Figure 1:
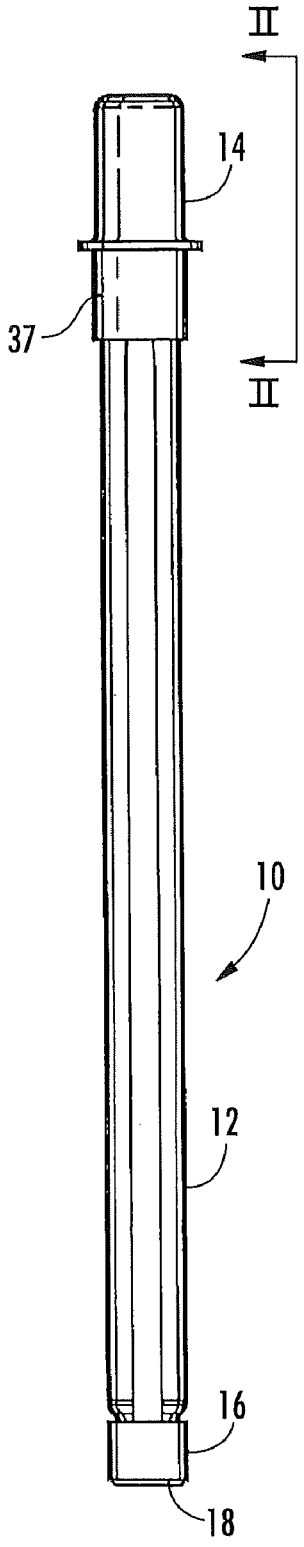
FIG. 1 shows a side view of an embodiment of a rock anchor, in accordance with the invention.
Figure 2:
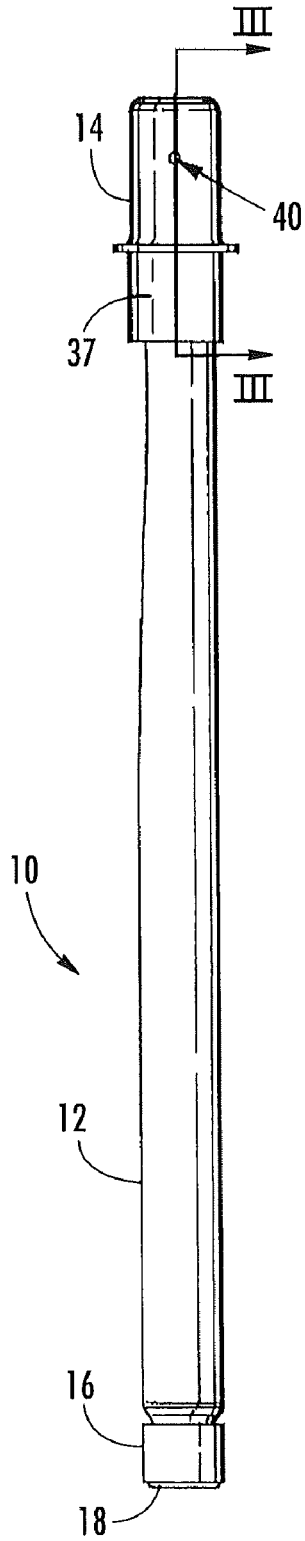
FIG. 2 shows a side view of the rock anchor of FIG. 1, in the direction of arrows II-II of FIG. 1.
Figure 3:
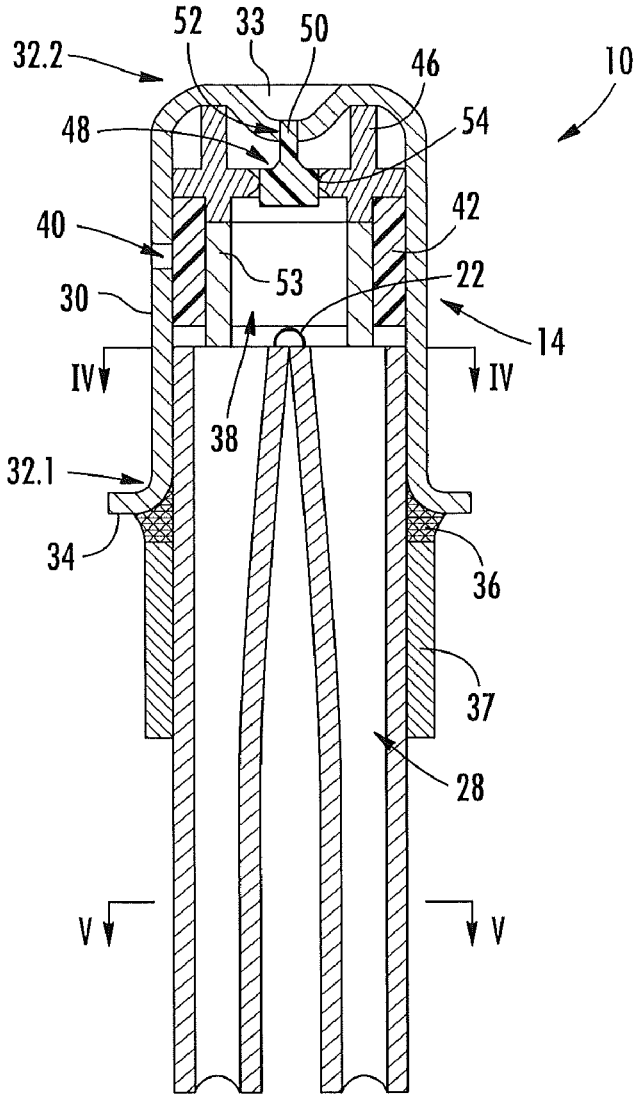
FIG. 3 shows a partial long-section of the rock anchor of FIG. 1 at III-III in FIG. 2, with pressure indicator means thereof in a first configuration thereof, prior to inflating an anchor tube of the rock anchor.

In FIG. 1, a first embodiment of a rock anchor, in accordance with the invention, is designated generally by the reference numeral 10. The rock anchor 10 includes a ductile steel anchor tube 12, an end cap 14 on a trailing end of the tube 12, and a ferrule 16 on a closed leading end 18 of the tube 12.

Figure 5:
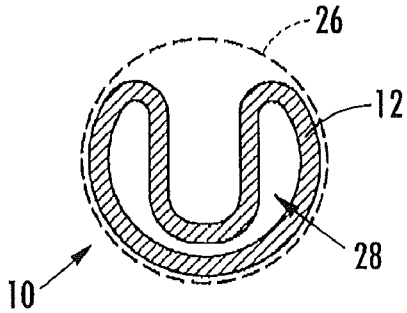
FIG. 5 shows a cross-section through the rock anchor of FIG. 3, at V-V of FIG. 3.

The tube 12 is made of ductile steel and defines, along most of its length, a cross-section substantially as shown in FIG. 5. The leading end 18 of the tube 12 is swaged down in diameter and the ferrule 16 is welded or crimped onto this end.

Figure 4:
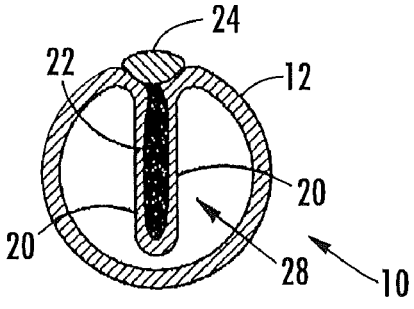
FIG. 4 shows a cross-section through the rock anchor of FIG. 3, at IV-IV in FIG. 3.

With reference particularly to FIG. 4, the cross-section of the trailing end of the tube 12 is substantially as shown here, defining a substantially round perimeter and an inward fold comprised of two wall parts 20 which are welded together at the second end of the tube 12 via a weld 22, transverse to the tube 12. A weld 24 extends along a mouth of the fold, which in turn extends along a short length of the tube 12.

As was stated before, along most of its length, the tube 12 defines a cross-section substantially as shown in FIG. 5. This cross-section can be circumscribed by a circle 26, which has a diameter equal to or smaller than that of a bore to be defined in rock (not shown) in which the rock anchor 10 is to be installed. The tube 12 defines along its length a tube cavity 28, of which the cross-section clearly varies along the length.

Figure 6:
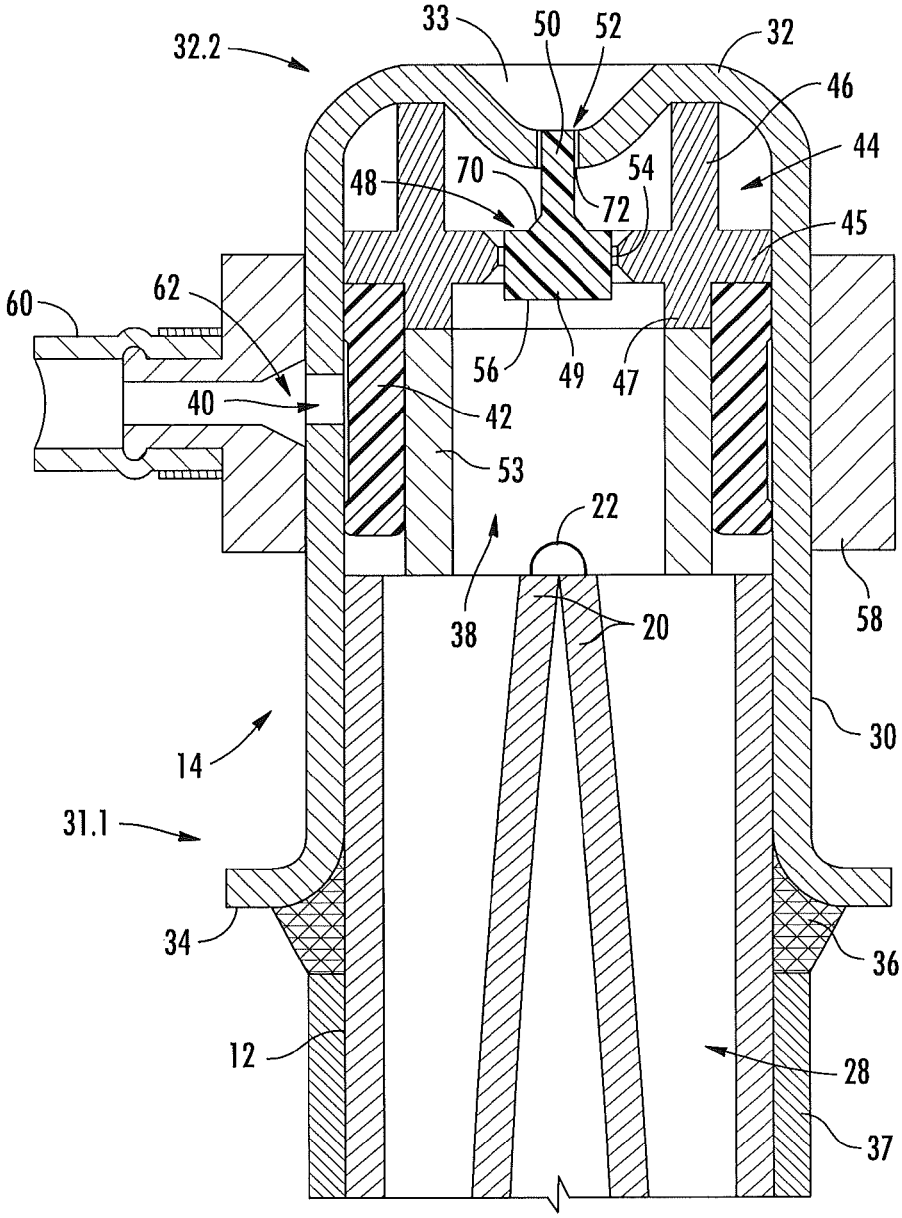
FIG. 6 shows a long-section of an end cap and an adjacent tube portion of the rock anchor of FIG. 1 and of a coupling of a high pressure water hose fitted around the cap for pressure feeding water into the rock anchor.

With reference particularly to FIG. 6, the end cap 14 is made of formed steel and includes a round cylindrical ferrule 30, defining a first end 31.1 and a second end 31.2, an end wall 32 closing off the second end 31.2 of the ferrule, and a flared-out flange formation 34 at the first end 31.1 of the ferrule 30. The end wall 32 defines a central recess 33. The trailing end of the tube 12 has been inserted approximately halfway into the ferrule 30 and has been secured to the ferrule 30 and flange formation 34 via a circumferential weld 36. The welds 36, 22, and 24 (see FIG. 4) provide a liquid tight seal between the trailing end of the tube 12 and the end cap 14. Another ferrule 37 has been placed around the tube 12 against the weld 36 to reinforce the tube 12. The ferrule 37 is welded to the tube 12 via the weld 36.

The end cap 14 defines therein an end cap cavity 38 that is in communication with the tube cavity 28.

The flared-out flange formation 34 is for bearing against a load washer, if required, which may operatively be fitted around the ferrule 37.

In a middle region of the length of the ferrule 30, it defines therethrough a feed aperture 40, providing for a liquid substance, such as water or grout, to be pressure-fed into the cavities 38 and 28 for inflating the tube 12. This aperture 40 is laterally disposed with respect to the end cap 14. On the inside of the ferrule 30, an annular resiliently flexible elastomeric one-way or non-return closure 42 is fitted. The closure 42 effectively seals off the aperture 40 and its operation will be described in more detail below. As an alternative to the closure 42, another type of one-way valve (not shown) may be provided in the end cap 14, e.g. at the trailing end of the tube 12.

In a region of the cavity 38 between the closure 42 and the end wall 32, an injection moulded plastics material (or other suitable material) insert 44 is provided. The insert 44 includes:

- an annular flange-like formation 45;
- two short tubular projections 46 and 47 on opposite sides of the formation 45; and
- a pressure indicator part 48 including a cylindrical body 49 and an indicator formation in the form of a pin 50 projecting from the body 49.

A tubular spacer 53 is inserted between the insert 44 and the trailing end of the tube 12 to prevent heat generated by forming the weld 36 from damaging the insert 44.

Each of the body 49 and the pin 50 is coaxial with the ferrule 30. The end wall 32 defines therethrough an indicator formation aperture 52 within which a free end of the pin 50 is located. Each of the body 49 and the pin 50 is shown in a first position thereof. The body 49 is connected to the formation 45 via holding means in the form of a peripheral frangible formation 54 which seals hermetically between opposite sides of the flange-like formation 45. The body 49 defines a contact surface 56, exposed to the cavity 38.

In this example, the tube 12 of the rock anchor 10 will be filled with water, but those skilled in the art will understand that another suitable liquid substance may alternatively be used.

With reference still particularly to FIG. 6, a collar-like coupling 58 of a high pressure water hose 60 has been sealingly fitted around the ferrule 30. The coupling 58 defines a water outlet 62, which has been brought into register with the feed aperture 40 of the end cap 14. Water may be pressure fed via the hose 60 and the coupling 58 into the cavities 38 and 28. Such pressure feeding of water causes local elastic deformation of the closure 42 in the region of the feed aperture 40, thus effectively opening the aperture.

The tubular projection 47 defines between itself and the ferrule 30 a circumferential slot within which a circumferential edge portion of the closure 42 is received. The closure 42 thus provides a seal preventing passage of water from the cavity 38 past the flange-like formation 45. In an alternative embodiment, the flange-like formation 45 may be provided with an outer seal, e.g. an O-ring seal in a circumferential ridge defined by it, sealing between the flange formation and the ferrule 30.

The tubular projection 46 bears against the inside of the end wall 32. It thus serves to locate the insert 44.

The pressure indicator part 48 defines a frusto-conical seat formation 70 and the end wall 32 defines around the aperture 52 a seat formation 72 mated to the seat formation 70. The purpose of the seat formations 70 and 72 will be described below.

With reference particularly to FIGS. 1 and 6, in order to install the rock anchor 10 into a bore defined in rock, its anchor tube 12 is inserted into the bore with its leading end 18 first. The coupling 58 is fitted onto the end cap 14. Water is fed under pressure via the feed aperture 40 into the cavities 38 and 28. This causes ductile cross-sectional expansion of the tube 12 in the bore to yield a frictional bond with the rock. Insofar as such friction bonding is known, it will not be elaborated on herein.

Figure 7:
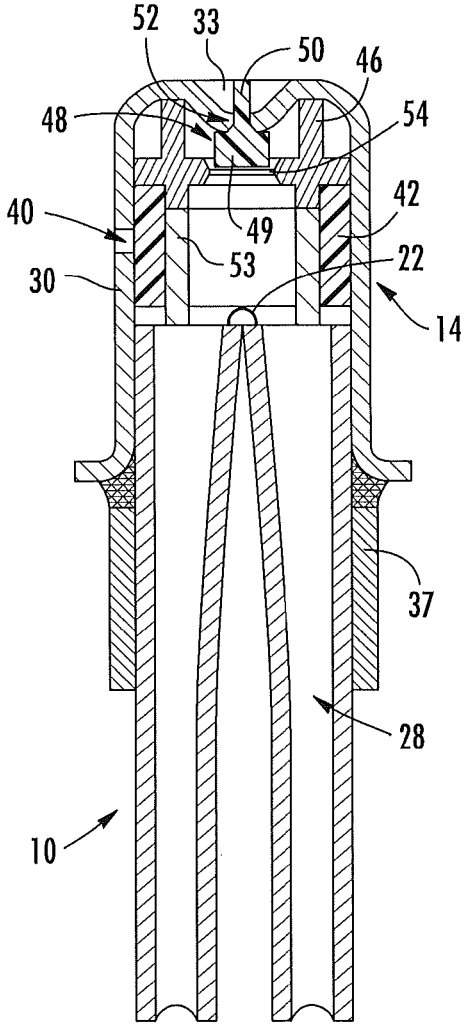
FIG. 7 shows a section of the rock anchor of FIG. 1, corresponding to the section of FIG. 3, but with the pressure indicator means in a second configuration thereof, after inflation of the tube.

Pressure in the cavities 38 and 28 also acts on the contact surface 56 of the pressure indicator part 48. Upon this pressure reaching a predetermined installation pressure, the frangible formation 54 yields or breaks and the pressure indicator part 48 is displaced into a second configuration thereof, as shown in FIG. 7. In this configuration, each of its body 49 and pin 50 is in a second position thereof. The pin 50 projects from the end wall 32. The seat formations 70 and 72 bear against each other, thus sealing off the aperture 52 and sealing off the cavities 38 and 28 from the atmosphere. The second position of the pin 50 is a projecting position in which it is clearly visible from the outside of the end cap 14. Its projection is an indication that the installation pressure has been reached in the tube 12 and pressure feeding of water into the tube 12 must be immediately terminated. Upon removal of the coupling 58 (see FIG. 6), resilience of the closure 42 and internal pressure in the cavity 38 forces the closure 42 radially outwardly, causing it to close off the feed aperture 40. The entire rock anchor 10 is now hermetically sealed.

Figure 8:
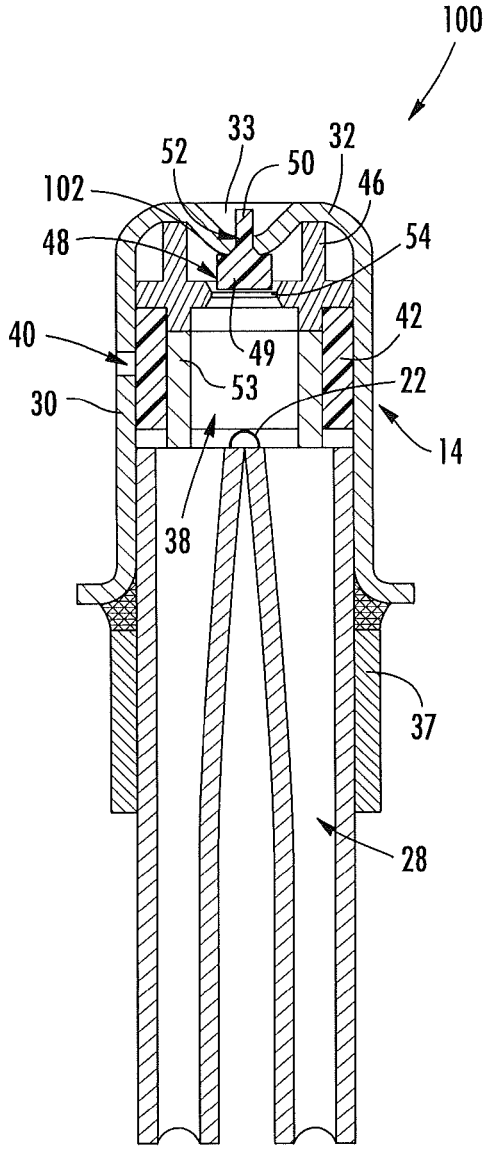
FIG. 8 shows a partial long-section, similar to that shown in FIG. 6, of another embodiment of a rock anchor, in accordance with the invention.

In FIG. 8, another embodiment of a rock anchor, in accordance with the invention, is designated generally by the reference numeral 100. The rock anchor 100 is identical to the rock anchor 10 of FIGS. 1 to 7, except that the body 49 of the pressure indicator part 48 has four angularly equi-spaced projections 102 (only two shown) on its side remote from the anchor tube 12. These bear against the end wall 32 of the end cap 14 when the body 49 is in its second position to prevent the body 49 from sealingly seating against the end wall to seal off the aperture 52. A liquid substance used to inflate the anchor tube 12 is thus permitted to escape past the pin 50 via the aperture 52. As such, pressure release of the liquid substance can occur.

Figure 9:
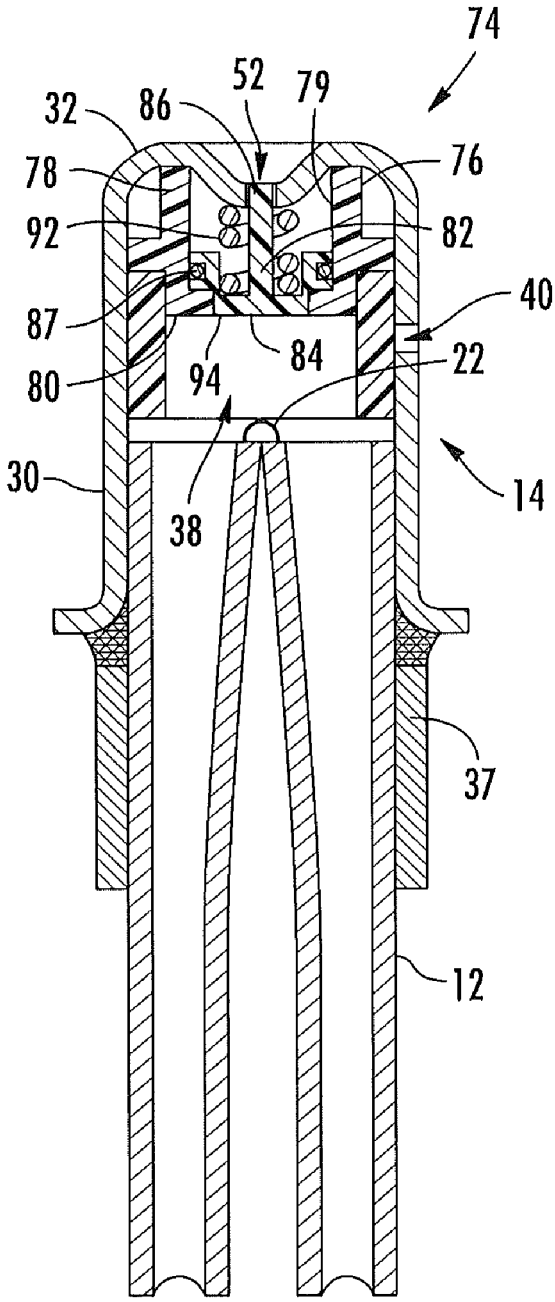
FIG. 9 shows a partial long-section, corresponding to that shown in FIG. 3, of yet another embodiment of a rock anchor, in accordance with the invention.

In FIG. 9, yet another embodiment of a rock anchor, in accordance with the invention, is designated generally by the reference numeral 74. The rock anchor 74 includes many features that are similar to features of the rock anchor 10 of FIGS. 1 to 7. Similar features, where designated, are thus designated again by the same reference numerals as before and a description of these features is not repeated here.

The end cap 14 of the rock anchor 74 has an insert 76 which is similar to, but not identical to, the insert 44 of the rock anchor 10, as shown in FIG. 6. The insert 76 includes a tubular part 78 defining therein a cylindrical inner surface 79. It includes also a flange-like formation 80, adjacent to the cavity 38, defining therein a round aperture. The rock anchor 74 includes also a pressure indicator including a body in the form of a piston 82, including a disc-like part 84 within the round aperture defined in the formation 80, and a pressure indicator formation in the form of a pin 86 projecting from the piston. The piston 82 defines a peripheral channel within which an O-ring seal 87 is received, which sealingly slides within the surface 79. The piston 82 is shown in a first position thereof, and so is the pin 86. A free end of the pin 86 sits inside the aperture 52 defined in the end wall 32. Holding means in the form of a coil spring 92 around the pin 86 acts between the end wall 32 and the piston 82. The piston 82 defines a contact surface 94 exposed to the cavity 38. Upon filling of the rock anchor 74 with water under pressure, the water bears against the contact surface 94. As pressure increases, the coil spring 92 yields elastically by being progressively compressed, displacing the pin 86 to project from the aperture 52 until the pin is in a second position thereof (not shown) when the pressure is at a predetermined installation pressure. The degree of protrusion of the pin 86 thus gives an indication of the water pressure inside the tube 12.

Clearly, the positioning of the aperture 40 in each embodiment of a rock anchor 10 and 74 in the above examples permits convenient location of the pressure indicator means centrally with respect to the end cap 14. It particularly provides for the pressure indicator means to cooperate with an aperture 52 centrally in the end wall 32 of the end cap 14.

The invention claimed is:

1. A rock anchor which includes:

an elongate, hydraulically inflatable anchor tube made of a ductile material and defining a closed leading end, a trailing end, and a tube cavity extending between the ends;

an end cap on a trailing end of the tube, defining a feed aperture in communication with the tube cavity for pressure feeding a liquid substance into the tube cavity for inflating the tube;

pressure indicator means, carried by the end cap, configured for indicating when, as a result of pressure feeding of a liquid substance into the tube cavity, a predetermined installation pressure is reached in the tube cavity; and a non-return closure for the feed aperture, and in which:

the pressure indicator means includes:

a body defining a contact surface exposed to an end cap cavity defined in the end cap, the end cap cavity being in communication with the tube cavity, the body before installation of the rock anchor being in a first position thereof relative to the end cap, and the body being displaceable, under liquid pressure against the contact surface, into a second position thereof;

an indicator formation, before installation of the rock anchor being in a first position thereof relative to the end cap and being displaceable into a second position thereof through displacement of the body into its second position, the second and first positions of the indicator formation being visually distinguishable from the outside of the end cap; and holding means holding the body in its first position against pressure on the contact surface, the holding means being configured for yielding when the predetermined installation pressure is reached in the end cap cavity;

the end cap includes:

a ferrule having opposite first and second ends, secured to the trailing end of the anchor tube so that the anchor tube extends from the first end; and an end wall at the second end;

the feed aperture is defined through the ferrule;

the end wall defines therethrough an indicator formation aperture for the indicator formation a portion of the ferrule, extending from the second end of the ferrule and past the feed aperture, defines a round cylindrical outer surface permitting snug sliding entry of said portion into a round entry of a collar-like coupling of a high pressure water hose.

2. A rock anchor as claimed in claim 1, in which the indicator formation and the body of the pressure indicator means define a single part.

3. A rock anchor as claimed in claim 1, in which the holding means includes a frangible formation.

4. A rock anchor as claimed in claim 1, in which the holding means includes biasing means biasing the body of the pressure indicator means towards its first position.

5. A rock anchor as claimed in claim 1, in which:

the direction from the first position to the second position of the indicator formation is the same as the direction from the first end to the second end of the ferrule; and when in its second position, the indicator formation protrudes from the end wall through the indicator formation aperture.

6. A rock anchor as claimed in claim 5, in which the indicator formation aperture is central in the end wall.

7. A rock anchor as claimed in claim 1, in which the end wall and the body of the pressure indicator means define complementary seat formations that sealingly abut each other in the second position of the body, thus closing off the indicator formation aperture.

8. A rock anchor as claimed in claim 1, in which the pressure indicator means is configured for permitting release of pressure from the tube cavity via the indicator formation aperture when the indicator formation is in its second position.

9. A rock anchor as claimed in claim 1, wherein the non-return closure for the feed aperture, includes a resiliently flexible annular formation which is fitted snugly inside the ferrule, which normally closes off the feed aperture, and which is locally displaceable away from the ferrule under pressure of a liquid substance fed into the feed aperture.

* * * * *

UNITED STATES PATENT AND TRADEMARK OFFICE

CERTIFICATE OF CORRECTION

PATENT NO. : 8,100,607 B2
APPLICATION NO. : 12/743617
DATED : January 24, 2012
INVENTOR(S) : Custers It is certified that error appears in the above-identified patent and that said Letters Patent is hereby corrected as shown below:

In the Claims:

Column 6, Claim 2, Line 34: Please correct "A rock anchor"
to read -- The rock anchor --

Column 6, Claim 3, Line 37: Please correct "A rock anchor"
to read -- The rock anchor --

Column 6, Claim 4, Line 39: Please correct "A rock anchor"
to read -- The rock anchor --

Column 6, Claim 5, Line 43: Please correct "A rock anchor"
to read -- The rock anchor --

Column 6, Claim 6, Line 49: Please correct "A rock anchor"
to read -- The rock anchor --

Column 6, Claim 7, Line 51: Please correct "A rock anchor"
to read -- The rock anchor --

Column 6, Claim 8, Line 56: Please correct "A rock anchor"
to read -- The rock anchor --

Column 6, Claim 9, Line 60: Please correct "A rock anchor"
to read -- The rock anchor --

Signed and Sealed this
First Day of May, 2012

David J. Kappos

David J. Kappos
*Director of the United States Patent and Trademark Office*